US006275198B1

(12) United States Patent
Kenoun et al.

(10) Patent No.: US 6,275,198 B1
(45) Date of Patent: Aug. 14, 2001

(54) WIDE BAND DUAL MODE ANTENNA

(75) Inventors: Robert Kenoun, Palatine; Guangping Zhou, Arlington Heights, both of IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/481,473

(22) Filed: Jan. 11, 2000

(51) Int. Cl.[7] ..... H01Q 1/36; H01Q 1/24
(52) U.S. Cl. ..... 343/895; 343/702
(58) Field of Search ..... 343/895, 900, 343/790, 791, 792; H01Q 1/24, 1/36

(56) References Cited

U.S. PATENT DOCUMENTS

| | | | | |
|---|---|---|---|---|
| 2,419,611 | | 4/1947 | Walsh et al. . | |
| 4,121,218 | | 10/1978 | Irwin et al. . | |
| 4,229,743 | | 10/1980 | Vo et al. . | |
| 4,868,576 | | 9/1989 | Johnson, Jr. . | |
| 5,446,469 | | 8/1995 | Makino . | |
| 5,583,520 | | 12/1996 | Thill . | |
| 5,594,457 | | 1/1997 | Wingo . | |
| 5,612,704 | | 3/1997 | Cole . | |
| 5,710,567 | | 1/1998 | Funke . | |
| 6,075,488 | * | 6/2000 | Hope | 343/702 |
| 6,111,545 | * | 8/2000 | Saari | 343/702 |
| 6,130,651 | * | 10/2000 | Yanagisawa et al. | 343/895 |

FOREIGN PATENT DOCUMENTS

| | | | | |
|---|---|---|---|---|
| 22843/70 | | 1/1970 | (AU) . | |
| 0 635 898 A1 | | 7/1994 | (EP) . | |
| 0 790 666 A1 | | 2/1997 | (EP) . | |
| 2 253 949 | | 9/1992 | (GB) . | |
| 63-286008 | * | 11/1988 | (JP) | 343/702 |
| WO 94/10720 | | 5/1994 | (WO) . | |
| WO 97/00542 | | 1/1997 | (WO) . | |
| WO 97/18601 | | 5/1997 | (WO) . | |

* cited by examiner

*Primary Examiner*—Hoanganh Le
(74) *Attorney, Agent, or Firm*—Daniel R. Collopy; Michael C. Soldner

(57) ABSTRACT

A wide band dual mode antenna (10) includes an electrically conductive monopole portion (12), an electrically insulating core (32) having a dielectric constant and adjacent to the monopole portion (12), and an electrically conductive wire (50) adjacent to the core (32) and having a total length associated with a first resonant frequency. The wire (50) has first and second ends (52, 54), wherein the first end (52) is electrically coupled to the monopole portion (12) and the second end (54) is electrically floating. The wire (50) includes a plurality of intercoupled segments (56, 58, 62) that are adapted to create a current null point between the first and second ends (52, 54) at a second resonant frequency to define first and second portions of the wire (50). The sum of currents in the first and second portions is substantially equal to zero at the current null point and at least some of the current in the first portion flows in a direction different from that of at least some of the current in the second portion.

23 Claims, 2 Drawing Sheets

WIDE BAND DUAL MODE ANTENNA

FIELD OF THE INVENTION

The present invention relates generally to antennas. More particularly, the invention relates to a dual mode antenna having a monopole body that is electrically loaded by multi-segment self-coupled wire.

BACKGROUND OF THE INVENTION

Dual-band antennas are well-known and are widely used in a variety of wireless communication devices. In particular, dual-band antennas have become popular in connection with portable cellular devices such as cellular radiotelephones because they allow these devices to operate within more than one wireless communication system. For instance, a cellular phone having dual-band capability allows a user to access one or more cellular systems that may be present in a given region, or more importantly, the ability to select service from a plurality of systems so that the user can access at least one of the systems where, for example, none of the systems provides service in all the regions that are of interest to the user.

Presently, a number of commonly used cellular systems operate in different frequency bands. For example, time division multiplex access (TDMA) systems, one of which is commonly referred to as GSM, operate in bands from 890 Megahertz (MHZ) to 960 MHZ and 1710 MHZ to 1880 MHZ and are commonly used in European cellular systems. Also, for example, the Personal Communication System (PCS), which operates in a band from 1850 MHZ to 1990 MHZ, and analog systems such as AMPS, which operates in a band from 824 MHZ to 894 MHZ, are two popular cellular systems used in North America. Accordingly, some manufacturers have developed cellular phones that can operate in two or more of these popular cellular systems.

A cellular phone that operates in two or more frequency bands requires an antenna system that is capable of receiving and transmitting signals in these distinct frequency bands. In one known approach, the cellular phone includes two separate antennas that are specifically configured to receive signals in different frequency bands. Typically, one of the antennas is a retractable linear antenna and the other is a helical antenna that is located adjacent to the retractable antenna. When the linear antenna is in the retracted position, the helical antenna is active, and when the linear antenna is in the extended position, the helical antenna is shorted or otherwise disabled so that only the extended linear antenna conveys signals.

Another known approach uses a single antenna structure that has multiple resonance modes, thereby allowing the antenna to convey signals in two or more frequency bands. Typically, these dual-band antennas generate two or more modes of resonance using either two helical coils wound on a single core, or alternatively, a single coil having a variable pitch. In particular, one commercially available dual-band antenna is the model DHR-1992 from Ace Antenna Co., which is located in Chatsworth, Calif. The DHR-1992 uses a single variable pitch helically wound coil to operate at both GSM and PCS frequencies. Because of the size and packaging constraints associated with hand-held cellular phones, some manufacturers have found that a quarter wavelength "stubby" antenna with a helical winding is advantageous because it can provide a small size and a relatively broad bandwidth at two or more of the frequency ranges mentioned above.

The above-described known approaches to providing an antenna system that can operate in two or more frequency bands are relatively complex and costly. Namely, retractable antennas require a significant amount of electromechanical hardware, are physically inconvenient for a user, and may be easily damaged in the extended position. Retractable antennas are further disadvantageous because matching the antenna to transceiver circuitry in both the extended and retracted positions, while maintaining high antenna efficiency, is extremely difficult. Additionally, a stubby antenna design using two helical coils requires precise winding (e.g., precise orthogonality) of two independent coils on a single core, which can result in inconsistent performance in units that are manufactured in a factory environment. Still further, while stubby antennas having a single variable pitch helical coil are simple in construction, they require an inherent design tradeoff such that sufficient bandwidth is typically only achievable at one of the resonant frequencies.

DETAILED DESCRIPTION OF THE PREFERRED EMBODIMENTS

The invention will have application apart from the preferred embodiments described herein, and the description is provided merely to illustrate and describe the invention and it should in no way be taken as limiting of the invention.

Figure 1:
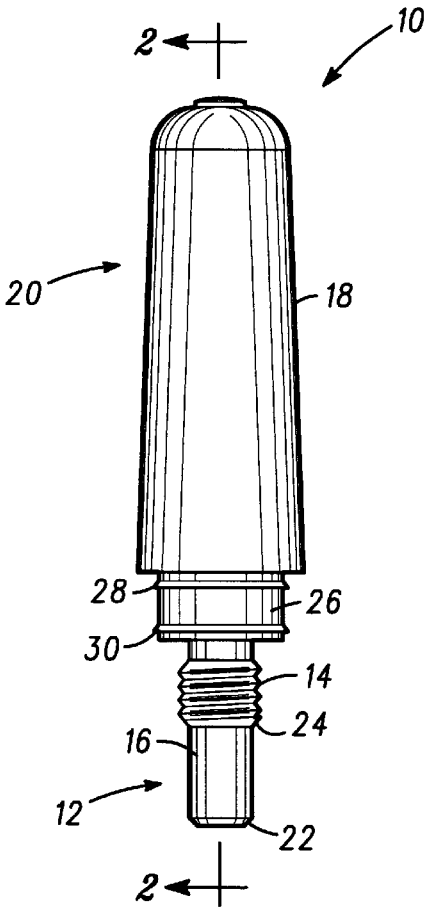
FIG. 1 is a side elevational view of a dual mode antenna according to the invention.

FIG. 1 is a side elevational view of a dual mode antenna 10 according to the invention. The antenna 10 includes a monopole portion 12 having a threaded portion 14 and a coupling portion 16. The antenna 10 further includes an outer housing 18 that encapsulates an upper portion 20 of the antenna 10.

The monopole portion 12 is adapted to mechanically secure the antenna 10 to a cellular communication device (not shown) such as a mobile phone, a pager, etc. and to electrically couple radio frequency signals conveyed through the antenna 10 to/from a transceiver circuit within the cellular communication device. In preferred embodiments, the threaded portion 14 of the monopole 12 is threadably engaged with a corresponding female threaded portion of the cellular communication device; however, many other types of fastening techniques could be used. Additionally, the coupling portion 16 of the monopole 12 is sized so that when the threaded portion 14 is securely engaged with the cellular device, the coupling portion 16 is in electrical contact with a receptacle (e.g., a spring type receptacle) associated with the transceiver circuit of the cellular communication device. The monopole portion 12 also preferably includes chamfers 22, 24 to facilitate assembly of the antenna 10 to the cellular communication device.

The monopole portion 12 is made from an electrically conductive material, such as a metal or metal alloy, suitable for providing both mechanical strength and electrical properties that are consistent with the requirements of conducting radio frequency signals in a portable cellular communication device. The monopole portion 12 can be fabricated from bar stock using a screw machine, for example, or can alternatively be a die-cast component on which a threaded portion is subsequently formed during a secondary fabrication operation. The surface of the monopole portion 12 is preferably plated with gold or any other suitable plating, for example, to enhance surface conductivity, to reduce contact resistance, and to resist corrosion.

The outer housing 18 encapsulates the upper portion 20 of the antenna 10 to provide mechanical protection to internal components of the antenna 10 (discussed in more detail below) and to provide a desirable aesthetic quality that enhances the appearance of the cellular communication device to which the antenna 10 is attached. The outer housing 18 includes a shank portion 26 that preferably includes circumferential ribs 28, 30. The shank portion 26 and ribs 28, 30 are configured to engage with a portion of the housing of the cellular communication device.

The outer housing 18 is preferably made of a thermoplastic material and is injection molded to keep costs low. Additionally, the thermoplastic material is selected to provide a predetermined dielectric constant. For example, a thermoplastic blend having about 75% santoprene and about 25% polypropylene is readily commercially available and provides a dielectric constant of about 2, which is compatible with the electrical coupling requirements of the antenna 10.

Figure 2:
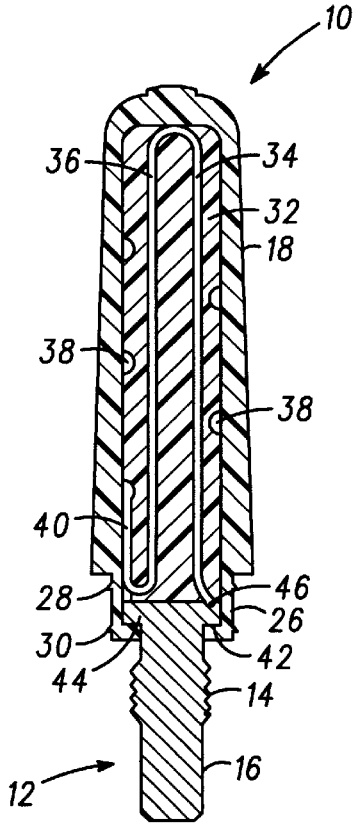
FIG. 2 is a cross-sectional view of the antenna of FIG. 1.

FIG. 2 is a cross-sectional view of the antenna 10 of FIG. 1. As shown, the outer housing 18 encapsulates an electrically insulating cylindrical core 32. The core 32 includes first and second axial bores 34, 36 and a helical groove 38 that is coupled to the second axial bore 36 via a channel 40. The bores 34, 36, the channel 40, and the helical groove 38 are configured to accommodate an electrically conductive wire 50 (FIG. 3), which has been removed from FIG. 2 for clarity and is shown separately in FIG. 3.

The outer housing 18 includes a recess 42 that captures a head portion 44 of the monopole portion 12. The head portion 44 of the monopole portion 12 further includes a depression 46 for receiving a first end 52 (FIG. 3) of the wire 50. Preferably, the outer housing 18 holds the core 32 so that it abuts the head portion 44 of the monopole portion 12 and so that the core 32 is substantially coaxial with the monopole portion 12. The outer housing 18 is preferably molded directly over the core 32 and the head portion 44 of the monopole portion 12 in an overmold or insert molding operation; however, a design providing a press-fit or a snap-fit assembly could be used without departing from the scope of the invention.

The core 32 is also preferably made of a thermoplastic material, such as the aforementioned mixture of 75% santoprene and 25% polypropylene. The core 32 is preferably fabricated using an injection molding process, but could alternatively be fabricated from bar stock to which secondary drilling, milling, and/or grinding operations are applied to form the bores 34, 36, the helical groove 38, and the channel 40. In one preferred embodiment, the core 32 is cylindrically shaped to have a diameter of about 230 mils and a length of about 900 mils, the bores 34, 36 are substantially parallel and are spaced by a distance of about 125 mils, and the helical groove 38 has a pitch of about 300 mils and is spaced from the head portion 44 of the monopole portion 12 by the length of the channel 40, which is about 200 mils.

Figure 3:
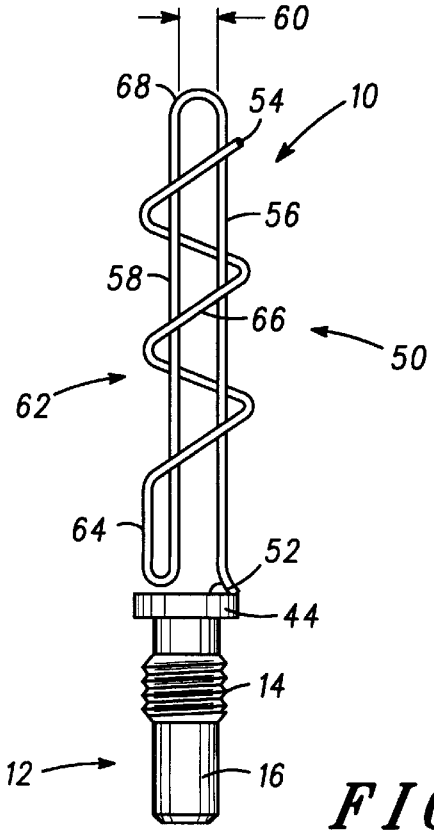
FIG. 3 illustrates a preferred configuration for the electrically conductive wire that traverses the bores, the channel, and the helical groove of the electrically insulating core shown in FIG. 2.

FIG. 3 illustrates a preferred configuration for the electrically conductive wire 50 that traverses the bores 34, 36, the channel 40, and the helical groove 38 of the core 32. The first end 52 of the wire 50 is electrically coupled to the monopole portion 12 and is preferably soldered, welded, or glued into the depression 46 (FIG. 2) of the head portion 44 of the monopole portion 12, and a second end 54 of the wire 50 is electrically floating. The length of the wire 50 includes a first segment 56 that traverses the first bore 34, a second segment 58 that traverses the second bore 36 and is spaced by a first distance 60 from the first segment (e.g., about 125 mils as in the above-noted preferred embodiment), and a third segment 62, which includes an offset portion 64 that traverses the channel 40 and a helical portion 66 that is wound in the helical groove 38 of the core 32. The wire 50 can be made of copper or can be made of steel with copper cladding or any other suitable plating material. Alternatively, a range of metals and alloys of metals can be used for making the wire 50 without departing from the scope of the invention.

Generally, the dimensions associated with the first, second and third segments 56, 58, 62 can be varied to adjust the frequency response of the antenna 10 at two or more resonant frequencies. Also, generally, the total length of the wire 50 and the intercoupling of the first through third segments 56, 58, 62 determines the modes of resonance and the bandwidth of the antenna 10 at the resonant frequencies.

More specifically, the total length of the wire 50 (which includes the length of the monopole 12) is selected to determine a first resonant frequency of the antenna 10, and the geometry and dimensions of the first through third segments 56, 58, 62 of the wire 50 determine the modes of resonance and the bandwidth at the second and third resonant frequencies. For example, the lengths of the first and second segments 56, 58 and the first distance 60, which separates the first and second segments 56, 58, can be varied to determine the modes of resonance. Namely, as the lengths of the first and second segments 56, 58 increase, the bandwidth at one or more of the resonant frequencies increases, and as the first distance 60 decreases, the modes of resonance come closer together (e.g., the difference between the second and first resonant frequencies decreases). In one preferred embodiment, the total length of the wire 50 is about 4.0625 inches, the lengths of the first and second segments 56, 58 are both about 900 mils, and the first and second segments 56, 58 are separated by a distance of about 125 mils.

The helical portion 66 of the third segment 62 surrounds the first and second segments 56, 58, so that the wire 50 is self-coupled to the first and second segments 56, 58 through the dielectric constant of the core 32. As a result, the length of the offset portion 64 of the third segment 62 can be varied to adjust the bandwidth of the frequency response of the antenna 10 at the first and second resonant frequencies. For example, if the length of the offset portion 64 is shortened so that the helical portion 66 begins in close proximity to the head portion 44 of the monopole portion 12, then the bandwidth at the first (i.e., the lower) resonant frequency decreases. Conversely, if the length of the offset portion 64 is increased to move the helical portion 66 away from the head portion 44 of the monopole portion 12 then the bandwidth at the first resonant frequency is increased. Thus, more bandwidth can be imparted at the first resonant frequency by adjusting the length of the offset portion 64. In a preferred embodiment, the length of the offset portion 64 is about 250 mils, and the helical portion 66 includes about two to four turns having a diameter of about 230 mils and a pitch of about 300 mils.

The total length of the wire 50 (including the length of the monopole 12) is typically selected to be a quarter wavelength at the first (i.e., lower) resonant frequency. For example, setting the length equal to 4.0625 inches provides a first resonant frequency in the GSM band. On the other hand, the second (i.e., higher) resonant frequency, which, for example, is in the PCS band, results from the intercoupling of the segments 56, 58, 62 of the wire 50.

In operation, the first through third segments 56, 58, 62 are adapted to produce a current null point between the first and second ends 52, 54 at the second resonant frequency. The current null point divides the wire 50 into first and second portions wherein the first portion extends from the first end 52 to the current null point and the second portion extends from the current null point to the second end 54. At the second resonant frequency, the sum of the currents at the current null point are substantially equal to zero. Thus, the current null point creates a second electrically floating point, which functions like an open circuit along the length of the wire 50, thereby reducing the effective length of the antenna 10 to the length of the first portion of the wire 50, which extends between the first end 52 and the current null point. The first portion of the wire 50 preferably has a length equal to about a quarter wavelength at the second resonant frequency.

Additionally, because of the geometry of the wire 50, at the second resonant frequency at least some of the current in the first portion flows in a direction opposite to that of at least some of the current in the second portion. For example, where the current null point exists in the U-shaped portion 68 between the first and second segments 56, 58, the first portion includes the first segment 56 and the second portion includes the second segment 58. The currents flowing in the first and second segments 56, 58, and thus at least some of the currents in the first and second portions, flow in opposing directions along the axis of the antenna 10.

In comparing one antenna constructed in accordance with the above-described invention to a conventional two-coil helical antenna, it has been shown that the antenna made in accordance with the invention yields a 57% increase in bandwidth at GSM frequencies while maintaining a high efficiency and bandwidth parity at PCS frequencies. This additional bandwidth provided by the invention is highly advantageous because it allows unit to unit antenna performance to be more consistent despite manufacturing tolerances and variations in the electromagnetic fields that impinge on the antenna, which are often caused by the user holding the cellular communication device.

Figure 4:
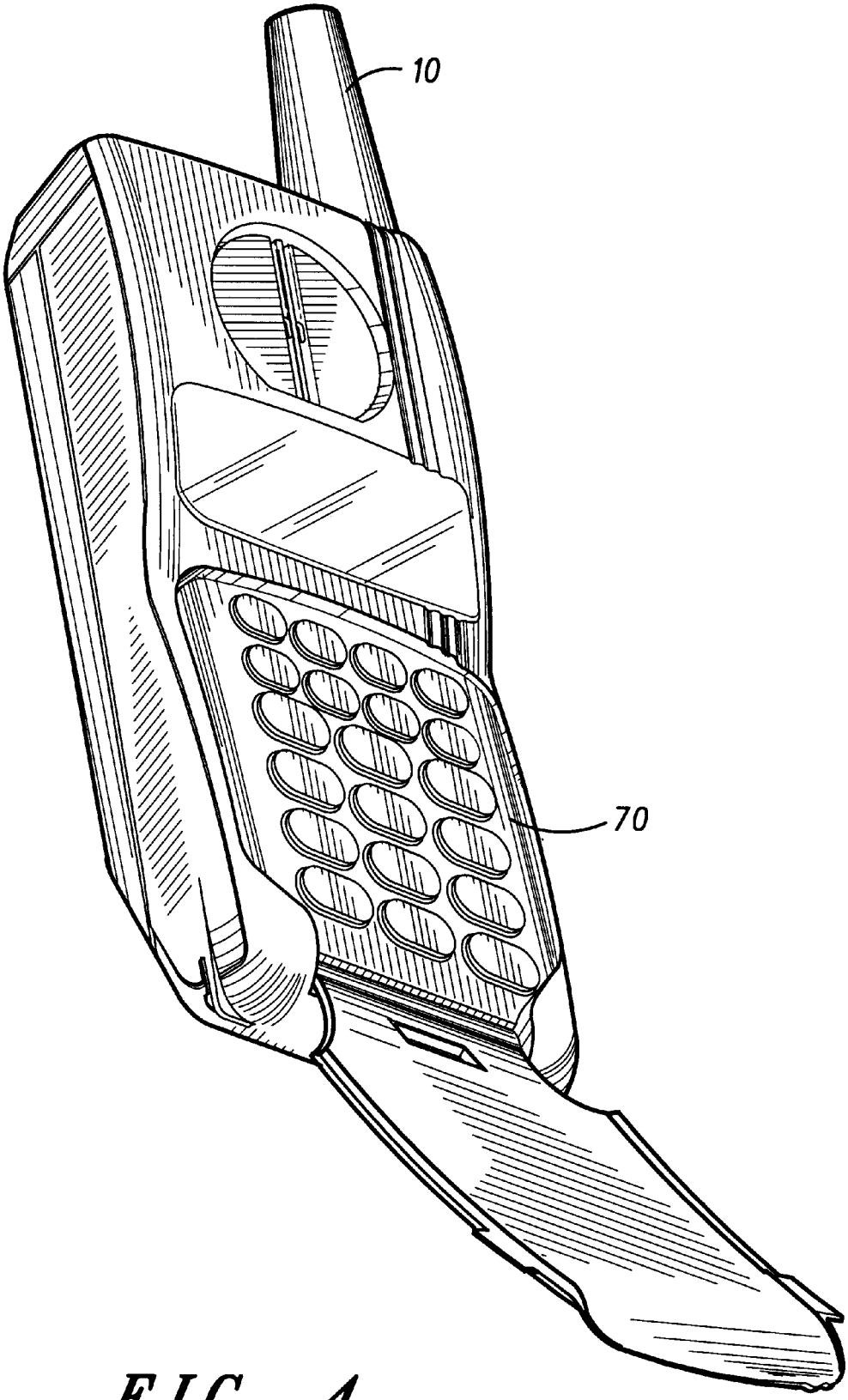
FIG. 4 illustrates the dual mode antenna of FIG. 1 coupled to a wireless communication device.

The above-described invention can be used with a variety of wireless communication devices to accomplish a wide variety of wireless communication applications. For example, FIG. 4 illustrates the antenna 10 coupled to a hand-held cellular telephone 70; however, the antenna 10 could alternatively be used with other similar wireless communication devices, such as a pager.

Many additional changes and modifications could be made to the invention without departing from the fair scope and spirit thereof. The scope of some changes is discussed above. The scope of others will become apparent from the appended claims.

What is claimed is:

1. A wide band dual mode antenna, comprising:

an electrically conductive monopole portion;

an electrically insulating core having a dielectric constant and adjacent to the monopole portion; and an electrically conductive wire adjacent to the core and having a total length associated with a predetermined resonant frequency, the wire comprising first and second ends, wherein the first end is electrically coupled to the monopole portion and the second end is electrically floating, the total length of the wire comprising first, second and third segments, the first segment having a first length extending from the first end along an axis of the core and the second segment having a second length extending along the axis of the core, the first and second segments being separated by a first distance such that at least the first and second lengths and the first distance are associated with creating a current null point between the first and seconds ends at a second resonant frequency, and the third segment comprising a helical portion adapted to self-couple the wire through the dielectric constant of the core to electrically load the monopole portion.

2. The antenna of claim 1, wherein the third segment further comprises an offset portion having a third length associated with a first bandwidth at one of the first and second resonant frequencies, and wherein the helical portion is spaced from the monopole portion by the offset portion.

3. The antenna of claim 1, where in the first and second segments are substantially parallel.

4. The antenna of claim 1, further comprising an outer housing for encapsulating at least the core and wire.

5. Then antenna of claim 1, wherein the core is substantially coaxial with the monopole portion.

6. The antenna of claim 1, wherein the core comprises first and second bores extending along the axis of the core for receiving the first and second segments.

7. The antenna of claim 1, wherein the core further comprises a helical groove for accepting the at least the helical portion of the wire.

8. The antenna of claim 1, wherein the core is substantially cylindrical.

9. The antenna of claim 1, wherein the core is made of a thermoplastic material.

10. The antenna of claim 9, wherein the core comprises a composition including a blend of santoprene and polypropylene.

11. The antenna of claim 9, wherein the thermoplastic material has a dielectric constant of about 2.

12. The antenna of claim 1, wherein the first and second lengths are substantially equal.

13. The antenna of claim 12, wherein the first and second lengths are about 900 mils.

14. The antenna of claim 1, wherein the first distance is about 125 mils.

15. The antenna of claim 1, wherein the helical portion has a diameter of about 230 mils and a pitch of about 300 mils.

16. A wide band dual mode antenna, comprising:

an electrically conductive monopole portion;

an electrically insulating core having a dielectric constant and adjacent to the monopole portion; and an electrically conductive wire adjacent to the core and having a total length associated with a predetermined resonant frequency, the wire comprising first and second ends, wherein the first end is electrically coupled to the monopole portion and the second end is electrically floating, the total length of the wire comprising a plurality of intercoupled segments adapted to create a current null point between the first and second ends at a second resonant frequency to define first and second portions of the wire, wherein the sum of currents from the first and second portions is substantially equal to zero at the current null point, and wherein at least some of the current in the first portion flows in a direction different from that of at least some of the current in the second portion.

17. The antenna of claim 16, wherein the first portion includes the first end and the second portion includes the second end.

18. A electrically conductive wire for use in a wide band dual mode antenna having an electrically conductive monopole portion and an electrically insulating core, the wire comprising:

a total length associated with a first resonant frequency;

first and second ends, wherein the first end is electrically coupled to the monopole portion; and a plurality of intercoupled segments adapted to create a current null point between the first and second ends at a second resonant frequency to define first and second portions of the wire, wherein the sum of currents from the first and second portions is substantially equal to zero at the current null point, and wherein at least some of the current in the first portion flows in a direction different from that of at least some of the current in the second portion.

19. The antenna of claim 18, wherein the first portion includes the first end and the second portion includes the second end.

20. The wire of claim 18, wherein the plurality of intercoupled segments comprises first, second and third segments, the first segment extending from the first end along an axis of the core and the second segment extending along the axis of the core, the first and second segments being separated by a first distance such that at least the first and second segments and the first distance are associated with the second resonant frequency, and the third segment comprising a helical portion adapted to self-couple the wire through the core to electrically load the monopole portion.

21. The antenna of claim 20, wherein the third segment further comprises an offset portion having a third length associated with a first bandwidth at one of the first and second resonant frequencies, and wherein the helical portion is spaced from the monopole portion by the offset portion.

22. The wire of claim 18, wherein the second end is electrically floating.

23. A system for receiving radio frequency signals in a plurality of frequency bands, comprising:

a wireless radio frequency communication device; and an antenna coupled to the wireless radio frequency communication device and having a monopole portion and an electrically conductive wire, the wire having a total length associated with a first resonant frequency, first and second ends such that the first end is electrically coupled to the monopole portion, and a plurality of intercoupled segments adapted to create a current null point between the first and second ends at a second resonant frequency to define first and second portions of the wire so that the sum of currents from the first and second portions is substantially equal to zero at the current null point and at least some of the current in the first portion flows in a direction different from that of at least some of the current in the second portion.

* * * * *